United States Patent [19]

Lawson et al.

[11] Patent Number: 5,065,776

[45] Date of Patent: Nov. 19, 1991

[54] CIGARETTE WITH TOBACCO/GLASS FUEL WRAPPER

[75] Inventors: Jerry W. Lawson; William J. Casey, III, both of Clemmons, N.C.

[73] Assignee: R. J. Reynolds Tobacco Company, Winston-Salem, N.C.

[21] Appl. No.: 576,751

[22] Filed: Aug. 29, 1990

[51] Int. Cl.[5] ..... A24D 1/02; A24D 1/18

[52] U.S. Cl. ..... 131/365; 131/194

[58] Field of Search ..... 131/359-365, 131/369, 335, 273

[56] References Cited

U.S. PATENT DOCUMENTS

| | | | |
|---|---|---|---|
| 198,075 | 12/1977 | Brisbane . | |
| 1,581,619 | 4/1926 | Sulzberger . | |
| 2,020,646 | 11/1935 | Hornstein . | |
| 2,098,619 | 2/1936 | Finnell . | |
| 2,471,116 | 2/1949 | Newberger . | |
| 2,592,554 | 8/1946 | Frankenburg . | |
| 2,890,704 | 11/1954 | Lamm . | |
| 2,988,012 | 1/1957 | Lamm . | |
| 3,220,418 | 3/1962 | Cohn . | |
| 3,410,013 | 12/1968 | Calhoun . | |
| 4,433,697 | 2/1984 | Cline . | |
| 4,570,670 | 2/1986 | Sirota . | |
| 4,714,082 | 12/1987 | Banerjee et al. | 131/359 |
| 4,756,318 | 7/1988 | Clearman . | |

*Primary Examiner*—V. Millin

*Attorney, Agent, or Firm*—Grover M. Myers; David G. Conlin

[57] ABSTRACT

Disclosed are smoking articles, such as cigarettes, which include a short, i.e., about 9 mm long carbonaceous fuel element positioned in a heat exchange relationship with a physically separate aerosol generating means. Surrounding the fuel element is a tobacco/glass insulating wrapper, preferably comprising at least four layers, defined from the periphery of the fuel element as: (1) a first layer of glass fibers; (2) a first tobacco-containing sheet; (3) a second layer of glass fibers, and (4) a second tobacco-containing sheet.

20 Claims, 1 Drawing Sheet

CIGARETTE WITH TOBACCO/GLASS FUEL WRAPPER

FIELD OF THE INVENTION

The present invention relates to smoking articles such as cigarettes, and in particular, to cigarettes having a fuel element, a physically separate aerosol generating means, a mouthend piece, and a fibrous insulating wrapper surrounding at least a portion of the fuel element. Such smoking articles are capable of providing the smoker with the pleasures of smoking (e.g., smoking taste, feel, satisfaction, and the like).

BACKGROUND OF THE INVENTION

Cigarettes, cigars and pipes are popular smoking articles which use tobacco in various forms. Many improvements and alternatives to these smoking articles have been proposed through the years.

Various methods for altering the composition of mainstream tobacco smoke have also been proposed. For example, many tobacco substitutes can be found in U.S. Pat. No. 4,079,742 (Rainer et al.). In addition, tobacco substitute smoking materials having the tradenames Cytrel and NSM were introduced in Europe during the 1970's.

A number of patents have proposed articles which were said to generate flavored vapor and/or visible aerosol. Most of such articles have employed a combustible fuel source to provide an aerosol and/or to heat an aerosol forming material. See, for example, the background art cited in U.S. Pat. No. 4,714,082 (Banerjee et al.)

Smoking articles which are capable of providing the pleasures associated with cigarette smoking, by heating but not necessarily burning tobacco, and without delivering considerable quantities of incomplete combustion products, are described in the following U.S. Patents, the disclosures of which are hereby incorporated herein by reference; U.S. Pat. No. 4,708,151 (Shelar), U.S. Pat. No. 4,714,082 (Banerjee et al.), U.S. Pat. No. 4,732,168 (Resce et al.), U.S. Pat. No. 4,756,318 (Clearman et al.), U.S. Pat. No. 4,793,365 (Sensabaugh et al.), U.S. Pat. No. 4,819,665 (Roberts et al.), U.S. Pat. No. 4,827,950 (Banerjee et al.), U.S. Pat. No. 4,854,331 (Banerjee et al.), U.S. Pat. No. 4,858,630 (Banerjee et al.), U.S. Pat. No. 4,881,556 (Clearman et al.), U.S. Pat. No. 4,893,639 (White), U.S. Pat. No. 4,903,714 (Barnes et al.) and U.S. Pat. No. 4,938,238 (Barnes et al.).

These smoking articles employ a combustible fuel element for heat generation; and aerosol forming substances positioned physically separate from, and in a heat exchange relationship with, the fuel element. The aerosol generating means normally includes tobacco in various forms such as densified pellets, tobacco powder and tobacco extracts, as well as tobacco flavor modifiers and tobacco flavoring agents and aerosol forming substances such as glycerin. During smoking, heat generated by the fuel element acts to volatilize the aerosol forming substances, thereby providing an aerosol which resembles tobacco smoke. Such smoking articles yield extremely low levels of visible sidestream smoke as well as low levels of FTC "tar".

In U.S. Pat. No. 4,756,318 to Clearman et al., there is disclosed a smoking article (cigarette) comprising a short fuel element, a physically separate aerosol generating means and a mouthend piece, which includes a tobacco jacket surrounding at least a portion of the aerosol generating means. As discussed therein at Col. 15, line 60–Col. 16, line 35, the tobacco jacket may also contain glass fibers, which may be in sheet, strip, or tube form. Tobacco sheets containing glass fibers are described as being prepared using conventional paper making techniques, and the amount of glass incorporated into such material is said to range from about 30 to about 70 weight percent.

Improvements in smoking articles such as those described in Clearman et al. are clearly desirable. The present invention represents such an improvement.

SUMMARY OF THE INVENTION

The present invention provides improved cigarettes and other smoking articles, in which layers of tobacco or tobacco-containing materials are used in conjunction with layers of noncombustible, preferably fibrous, insulative material(s), preferably glass fibers.

Preferred embodiments of the present invention utilize layers comprised primarily of tobacco or tobacco flavorant materials, alternating with one or more layers comprised primarily of fibrous insulative materials such as glass fibers, arranged in such a manner that tobacco or other flavors and aromas are delivered to the smoker without substantial tobacco pyrolysis or degradation products. Particularly preferred tobacco/glass wrappers of the present invention comprise a laminated sheet material of at least four layers, described from the outside of the article to the inside as: tobacco—glass—tobacco—glass. In use, this combination appears as four concentric rings around the fuel element in the finished cigarette.

In general, the present invention provides a smoking article comprising (1) a short, combustible fuel element and (2) an insulating wrapper surrounding at least a portion of the outer periphery of the fuel element, the insulating wrapper comprising at least one layer of a fibrous insulating material and at least one layer of a tobacco-containing material. If desired, an aerosol generating means may be disposed longitudinally behind the fuel element.

As described above, in certain preferred embodiments of the present invention, the fuel element of the smoking article is peripherally surrounded by a tobacco/glass wrapper preferably comprising at least four layers: (1) a first layer of glass fibers; (2) a first tobacco-containing sheet; (3) a second layer of glass fibers; and (4) a second tobacco-containing sheet. This arrangement can be varied and/or modified to change the nature of the tobacco flavor and aroma provided by the wrapper. For example, in order to increase the amount of delivered flavorant, the glass fibers layers can include some tobacco, or one or more tobacco or other flavorant materials. Similarly, the sheet(s) comprising primarily tobacco or tobacco flavorant materials (i.e., the tobacco-containing sheet(s)) can also include glass fibers or other fibrous materials, e.g., to increase the structural integrity of the layers. The spatial arrangement of the layers, i.e., how they are layered over the fuel element and/or one another, can likewise be varied to modify the properties of the smoking article.

By employing the tobacco/glass wrapper of the present invention, the flavor of the aerosol delivered to the smoker is substantially enhanced as compared with aerosols produced in the absence of such a structure, e.g., utilizing an insulating layer of glass fibers, without tobacco or a tobacco flavorant.

Preferably this improvement in the aerosol flavor is achieved without substantial burning of the tobacco, and it is believed that the physical structure of the preferred embodiments is at least partially responsible for the ability to achieve this goal. Smoking articles produced in accordance with the present invention compare favorably in flavor to similar smoking articles but in which the tobacco is burned as the fuel. Preferably the aerosol produced in accordance with the present invention is low in combustion and incomplete combustion products of tobacco.

The insulating tobacco/glass wrapper of the present invention is advantageously only about 20 mm or less in length and is typically of sufficient overall thickness to provide the nominal circumference of a typical tobacco cigarette (about 24.5 mm) when placed around a fuel element. The overall thickness will depend upon the nature of the fuel element over which the insulating tobacco/glass wrapper is wrapped, and may range from about 1.5 to about 5 or 6 mm, but in conjunction with the fuel element and any wrapping paper or other elements of the fuel end of the smoking article, is preferably thick enough to provide an overall outer diameter of about 8 mm.

During smoking, the tobacco in the laminated tobacco/glass wrapper at least partially pyrolyzes, and may even burn to some small extent, thereby releasing to the atmosphere the unique aroma of tobacco smoke, an aroma that smokers expect from a cigarette. In addition to providing the aroma of a typical tobacco cigarette, the tobacco in the wrapper also contributes a detectable tobacco smoke taste to the mainstream aerosol produced by action of the heat of the fuel element on the aerosol generating means.

Thus, the present invention permits the addition of a small amount of tobacco, advantageously in sheet form, to the insulating wrapper, by which the cigarette smoke taste of the resulting article is substantially improved. The use of the present layered tobacco—insulator approach is believed to reduce the pyrolysis and/or burning of the tobacco involved, and thus permits control over the content of the mainstream aerosol, while simultaneously improving mainstream taste and sidestream aroma. This is accomplished in accordance with the present invention without the additions of off-tastes, and/or disagreeable aromas.

As described above, the preferred smoking article includes a short (i.e., less than about 30 mm in length prior to smoking) preferably carbonaceous, combustible fuel element. Typically, the fuel element is an extruded mass, about 9 mm in length and about 4.5 mm in diameter which is provided with a plurality of longitudinally extending passageways, i.e., defined longitudinal hole(s) passing through the inner portion of the fuel element, and/or slots located on the periphery of the fuel element. The passageways provide a surface area which assists in the lighting of the fuel element, and assists in maintaining burning of the fuel element during smolder. The passageways also aid in controlling the heat transfer from the fuel element to the aerosol generating means. The density of a typical fuel element ranges from about 0.85 to about 1.25 g/cc.

The preferred cigarette smoking articles of the present invention also include a roll or charge of tobacco, normally in cut filler form, wrapped in a wrapping material such as paper, thereby forming a tobacco rod. The tobacco roll preferably encircles at least a portion of the aerosol generating means. The tobacco can be in a processed form, such as volume expanded cut filler or aqueously extracted/volume expanded cut filler. The tobacco rod can also include an insulating material such as glass fibers as a component thereof.

The aerosol generating means of the preferred smoking article is physically separate from, and longitudinally disposed behind, the fuel element. Preferably the aerosol generating means is enclosed in a capsule, container or housing which is heat conductive or otherwise heat-resistant and is located in a passageway which extends longitudinally through the tobacco rod.

The heat conductive capsule, container or housing for the aerosol generating means (hereafter, capsule) contains one or more aerosol forming materials. Such aerosol forming materials can include tobacco in any form, such as tobacco dust, spray dried tobacco extracts or tobacco essences; and tobacco flavoring agents such as sugars, licorice and cocoa. Other aerosol forming materials which may be used herein include polyhydric alcohols, such as glycerin, propylene glycol and triethylene glycol, which vaporize to produce a visible, "smoke-like" aerosol. The aerosol forming materials within the container typically are carried by a substrate such as alumina beads, a fibrous carbon material, densified (e.g., marumerized) tobacco, carbon, alumina, or mixtures thereof, or other suitable materials known to the skilled artisan.

Preferred smoking articles also include a mouthend piece for delivering aerosol to the smoker, which in the case of cigarettes, typically have a tubular shape. However, the mouthend piece may be provided separately, e.g., in the form of a cigarette holder, or as a pipe. The mouthend piece of the preferred smoking articles typically include a filter plug segment. Preferred filter segments exhibit low filtration efficiencies so as to minimize interference with the passage of aerosol from the aerosol generating means to the mouth of the smoker during draw (i.e., upon use). Also preferred are mouthend pieces which include a segment of flavor-containing material, such as a loosely gathered or pleated tobacco paper or menthol-containing pleated carbon filled sheet between the aerosol generating means and the filter segment.

As used herein, the term "aerosol" is meant to include vapors, gases, particles, and the like, both visible and invisible, and especially those components perceived by the smoker to be "smoke-like," formed by the action of heat generated by the fuel element upon materials contained within the aerosol generating means, or elsewhere in the smoking article.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. A conductive heat exchange relationship can be achieved by placing the aerosol generating means in contact with the fuel element and thus in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means comprising primarily carbon. The amount of carbon in the carbonaceous material is typically greater than about 60 percent by weight, preferably greater than about 70 weight percent.

As used herein, the term "insulating materials" applies to all materials which act primarily as insulators. Preferably, these materials do not burn during use, but they may include slow burning carbons and the like materials, as well as materials which fuse during use, such as low temperature grades of glass fibers. Preferred insulating materials used herein are fibrous, e.g., glass fibers, carbon fibers, and the like. Collectively, these materials are often referred to merely as "glass". Suitable insulators have a thermal conductivity in g-cal (sec.) ($cm^2$) (°C./cm), of less than about 0.05, preferably less than about 0.02, most preferably less than about 0.005. See, Hackh's Chemical Dictionary 672 (4th ed., 1969) and Lange's Handbook of Chemistry 10, 272–274 (11th ed., 1973).

The term "tobacco-containing" is used herein to describe a material containing tobacco, in any amount, and in any of a variety of forms, including tobacco extracts, spray dried tobacco extracts, milled tobacco laminae, tobacco fines or dust, shredded or commutated tobacco laminae or stems, volume expanded tobacco and other forms of processed tobacco, and the like.

Preferred smoking articles employing the insulating wrapper of the present invention are capable of delivering at least 0.6 mg of the aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg of more of aerosol in the first 3 puffs. Most preferably, embodiments of the invention are capable of delivering 2 mg or more of aerosol in the first 3 puffs when smoked under FTC smoking conditions. Moreover, preferred embodiments of the invention deliver an average at least about 0.2 mg of WTPM per puff, for at least about 6 puffs, preferably at least about 10 puffs, under FTC smoking conditions.

DETAILED DESCRIPTION OF THE PREFERRED EMBODIMENTS

Figure 1:
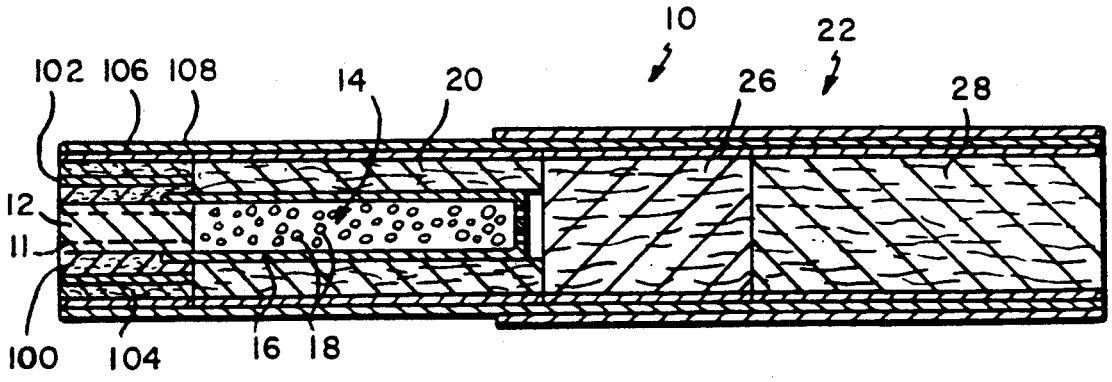
FIG. 1 is a longitudinal sectional view of a cigarette of the present invention.

Referring to FIG. 1, the cigarette smoking article 10 includes a fuel element 12 having a plurality of longitudinally extending passageways 11 (see FIGS. 1A and 1B); a physically separate aerosol generating means 14, which contains one or more aerosol forming materials and which is disposed behind the fuel element and which is surrounded by a heat conductive capsule 16. Capsule 16 overlaps the rearward periphery of the fuel element. Capsule 16 is at least partially surrounded by a tobacco-containing jacket 20. As illustrated, the mouthend piece 22 consists of two sections, namely (1) a segment of loosely gathered web of tobacco paper 26, which adds flavor to the aerosol, and (2) a web of nonwoven polypropylene, serving as filter element 28. Optionally, a void space (not shown) can be included in the mouthend piece, either between the capsule and the tobacco paper, or elsewhere.

A typical cigarette of the present invention has a generally circular cross-section and a circumference of from about 23 mm to about 28 mm, and a length of from about 70 mm to about 100 mm.

Referring in detail to FIG. 1, the fuel element 12 is held in place by the heat conductive capsule or container 16 by virtue of the overlap of the capsule or container with approximately the rear 2 mm of the fuel element periphery. The capsule has a diameter just large enough to accept the fuel element snugly and hold it, e.g., by friction fit.

The capsule is advantageously manufactured from a heat resistant material, such as a thin metal (e.g., aluminum) sheet. In this way heat is effectively conducted from the burning fuel element through the walls of the capsule or container to the aerosol forming materials retained therein. The capsule is generally a cylindrical tube, open at its forward end to accept the rear portion of the fuel element, and closed at the mouth end. The closed end of the capsule has one or more small openings to allow the vaporized aerosol forming material generated by heat from the fuel element to pass into the mouthend piece.

Figure 1A:
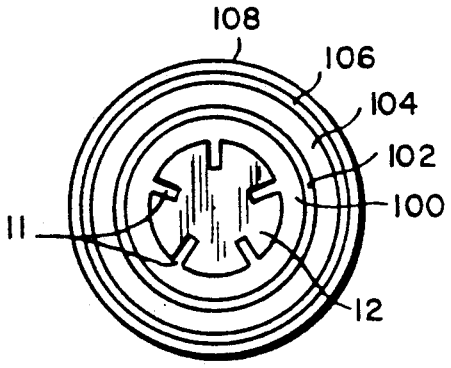
FIG. 1A is a sectional view of the cigarette illustrated in FIG. 1, taken along line 1A—1A.

Referring to FIGS. 1, and 1A, the fuel element 12 is surrounded by a plurality of concentric rings (or annuli) of tobacco-containing material and fibrous insulating material, preferably glass fibers. As illustrated in FIG. 1A, the preferred embodiment comprises a four annuli system including; (1) a first layer of glass fibers 100, adjacent the outer periphery of the fuel element 12; (2) a first tobacco-containing sheet material 102; (3) a second layer of glass fibers 104, adjacent the first tobacco-containing sheet 102; (3) a second tobacco-containing sheet material 106; and an outer paper wrapper 108.

In the cigarette embodiments of the present invention, the fibrous insulating material it typically from about 0.6 to about 1.5 mm thick, preferably about 1.2 mm thick. The thickness of the tobacco-containing sheet material is typically from about 0.09 to about 0.17 mm, preferably about 0.13 mm. For other smoking articles, the skilled artisan would vary the thicknesses of each component as necessary.

Referring again to FIG. 1, the aerosol generating means 14 is preferably surrounded by a rod, roll, or some other form of tobacco 20, generally in the form of cut filler. This tobacco segment is heated, but not necessarily burned, by the heat from the fuel element, thereby resulting in the release of tobacco flavor components into the mainstream aerosol during use of the smoking article. This tobacco segment also provides the cigarette with resiliency which aids in manufacture using modern high speed cigarette manufacturing equipment.

The substrate 18, which holds or retains the aerosol forming materials in the aerosol generating means, can have various forms. One or more types of substrate material can be incorporated into a portion of the capsule or container 16. For example, the substrate can include (i) alumina beads which preferably carry glycerin and a tobacco extract and which are positioned adjacent the back face of the fuel element; (ii) marumerized or otherwise densified tobacco, carbon, and/or alumina, containing one or more flavor materials and/or tobacco extracts and glycerine; and/or (iii) gathered tobacco paper which carries glycerin and a tobacco extract and is wrapped in a circumscribing paper wrapper. Other materials useful as substrates are well known to the skilled artisan.

As described above, the combination of the fuel element and the aerosol generating capsule or container, may be spaced apart from the mouthend piece 22 by a void space 24. This void space may range in size from about 5 mm to about 30 mm, preferably from about 10 mm to about 15 mm, with adjustments made to the sizes of the other components of the mouthend piece as required. This void space has two primary functions, (1) it allows the hot gases exiting the aerosol generating means to cool before reaching the smoker and (2) it aids in the formation of a visible smoke by serving as a nucleation chamber for the aerosol. Alternatively, the void space may be omitted, i.e., the space shown may be filled, e.g., with flavor additive materials, low efficiency filter materials, and the like.

The mouthend piece 22 preferably has a configuration and dimensions such that it can be butted against the front end assembly comprising the jacketed fuel element and capsule with a simple paper overwrap. Alternatively, the outer layer of the mouthend piece may be manufactured from any available material, e.g., metal foil—lined paper tubes, molded plastic, heavy weight paper, or the like.

Within the tubular mouthend piece 22 a roll 26 of tobacco-containing sheet material, or carbon filled sheet material containing a flavor substance such as menthol, or some other flavor source, preferably circumscribed by a paper wrapper, is positioned adjacent the void space 24. Also within the mouthend piece, and positioned at the extreme mouth end of the cigarette, is a low-efficiency filter element 28 including a filter material such as a gathered web of non-woven polypropylene fibers, and a circumscribing plug wrap. If desired, tipping paper can circumscribe the mouthend piece of the cigarette and join the mouthend piece to the front end assembly. Additionally, if desired, a ring of air dilution perforations can be provided near the extreme mouth end region of the cigarette using known laser or mechanical perforation techniques.

In use, the smoker lights the fuel element 12 which burns to produce heat. The heat generated is transferred through conduction and/or convection to the capsule 16 which surrounds one end of the fuel element. Heat from the capsule which is in contact with the substrate 18 and aerosol forming material assists in volatilizing the aerosol forming material. During draw by the smoker, heated air passes into the capsule where it contacts the substrate 18. This added heat applied to the aerosol forming material volatilizes it. The volatilized material exits the capsule through openings (not shown) in the capsule end wall. The drawn air and volatilized materials then cools during passage through the mouthend piece. Depending upon the particular aerosol forming material, a visible "smoke-like" aerosol is formed. Advantageously, the drawn air and volatilized material pass through the flavor materials situated in the mouthend piece, picking up flavor components therefrom, and pass finally into the mouth of the smoker.

The tobacco/glass insulating wrapper for the fuel element may be prepared by conventional techniques known to those skilled in this art. One preferred method involves overwrapping the fuel element/capsule assembly or cartridge, with a tobacco/glass insulating jacket material that is about 15 mm in length. One preferred tobacco/glass insulating jacket is composed of two layers of Owens-Corning C-glass mat with one sheet of reconstituted tobacco paper sandwiched between the layers of the glass and a second sheet of reconstituted tobacco paper overwrapping the outer layer of glass. One preferred reconstituted tobacco sheet, designated P2674-157 from Kimberly-Clark Corp., is a paper sheet containing a blended tobacco extract. The width of the preferred reconstituted tobacco sheets prior to forming are 19 mm (inner) and 26.5 mm (outer). The final diameter of this preferred jacketed cartridge is about 7.5 mm.

The preferred concentric tobacco/glass insulating jacket can be manufactured using a modified version of the apparatus described in U.S. Pat. No. 4,893,637 (Hancock et al.), the disclosure of which is hereby incorporated herein by reference. The modified apparatus includes a plurality of bobbins, containing both glass and a tobacco-containing material arranged so as to be interposed between the layers of glass as taught therein. The skilled artisan will appreciate that any number of different alternative layers of glass and/or tobacco may be prepared using this apparatus, simply by changing the bobbin arrangement and/or content.

Alternatively, the tobacco and glass can be combined into a common unit through either a wet laid or air laid process. Air laid processing is preferred when tobacco is included in the mixture, as tobacco flavor components can be lost in the wet laid process. The formation of a unitary tobacco/glass mat allows for control of peripheral air flow through the material to the fuel element. In addition to surrounding the fuel element, this unitary mat can also surround the heat conductive capsule for the aerosol generating means.

The amount of tobacco in such a unitary jacket can range from about 1 to about 99 percent by weight, preferably from about 40 to 70 percent by weight, and most preferably from about 50 to 60 percent by weight. A preferred glass for use in forming the unitary tobacco/glass wrapper is E-glass, available from Owens Corning.

As described above, the manufacture of the insulating jacket of the present invention may be made using conventional papermaking techniques as will be appreciated by those of ordinary skill in this art. Such methods include wet laid processing and air laid processing.

In the wet laid process tobacco, generally in cut filler form, is mixed in the white water with glass fibers. The ratio of tobacco to glass in the mixture can range from about 4:1 to about 1:1. This mixture is passed to the head box where a mat-like paper sheet comprising tobacco and glass fibers is generated after pressing out the moisture.

In general, the tobacco and glass components are mixed with water and the slurry applied to a papermaking wire where the water is removed and the sheet may be dried by passing over and between heated rolls. Wet strength agents may be used to increase the strength of the jacket.

In the air laid process the tobacco cut filler and the glass fibers are first ground to a small particle size, to facilitate transfer by air. The ground particles are then conveyed by air feed to a commutator where they are mixed. This intimate mixture is then fed to a form, which acts as the equivalent of the wet laid head box, where through the application of a vacuum, the air laid mat is formed. The air laid mat may then be treated with a binder such as SCMC or the like, to provide structural integrity. Alternatively, the air laid process can be conducted in separate stages, thereby forming a layered mat of glass and tobacco, with as many different layers as desired.

The air laid and/or wet laid tobacco/glass insulating jackets may be used over the entire length of the front end of the smoking article, i.e., over both the fuel element and the aerosol generating means. Alternatively, such jackets may be employed over only a portion of the front end assembly.

As described above, the smoking article of the present invention includes a fuel element which generates heat sufficient to volatilize aerosol forming material within the aerosol generating means. A preferred fuel element is manufactured from a combustible material in such a way that the density of the fuel element is greater than about 0.5 g/cc, often greater than about 0.8 g/cc or more, but typically less than about 1.5 g/cc. Additionally, the fuel element generally has a length of less than about 20 mm, often less than about 15 mm, and is typically about 9 mm.

The composition of the combustible materials of the fuel element can vary. Preferred fuel elements contain carbon, and highly preferred fuel elements are composed of primarily carbonaceous materials. Preferred carbonaceous fuel elements have a carbon content above about 60 weight percent, more preferably above about 70 weight percent. In several preferred embodiments of carbonaceous fuel elements, the fuel element comprises a mixture of carbon, tobacco, and a binder (see, e.g., Example 1). In other preferred embodiments of carbonaceous fuel elements, no tobacco is incorporated in the fuel (see, e.g., U.S. Pat. Nos. 4,854,331 and 4,917,128).

In addition to having tobacco in the fuel element, other ingredients such as flavors, tobacco extracts, fillers (e.g., clays or calcium carbonate), burn additives (e.g., sodium chloride to improve smoldering and act as a glow retardant), combustion modifying agents (e.g., potassium carbonate to control flammability), binders, and the like, can be incorporated therein. Exemplary compositions of carbonaceous fuel elements are set forth in U.S. Pat. Nos. 4,714,082 (Banerjee et al.) and 4,756,318 (Clearman et al.).

Other combustible fuel elements can be provided from comminuted tobacco material, reconsitituted tobacco material, heat treated or pyrolyzed tobacco materials, cellulosic materials, modified cellulosic materials, and the like. Exemplary combustible materials are set forth in U.S. Pat. Nos. 4,347,855 (Lanzilotti et al.), 3,931,824 (Miano et al.), 3,885,574 (Borthwick et al.) and 4,008,723 (Borthwick et al.), as well as in Sittig, Tobacco Substitutes, Noyes Data Corp. (1976).

Fuel elements for the smoking articles of the present invention are advantageously molded, machined, pressure formed or extruded into the desired shape. Preferred extruded carbonaceous fuel elements can be prepared by admixing up to about 95 parts carbonaceous material, up to about 20 parts binding agent and up to about 20 parts tobacco (e.g., tobacco dust and/or a tobacco extract) with sufficient water to provide a paste having a stiff dough-like consistency. The paste then can be extruded using a ram or piston type extruder into the desired shape having the desired number of passageways or void spaces. The extruded paste then can be dried to a moisture content of about 2 to about 7 weight percent. Then, a continuous length of extrudate is cut at regular intervals to provide a plurality of individual fuel elements.

The smoking article of the present invention also includes an aerosol generating means which is physically separate from the fuel element. As such, the aerosol generating means is, not mixed with, nor is it a part of, the fuel element. The aerosol generating means is in a heat exchange relationship with the fuel element in order that heat generated by the burning fuel element is transferred to the aerosol generating means for heating the aerosol forming material and resultant aerosol formation.

The preferred aerosol generating means include a substrate for carrying the aerosol forming material. Preferred substrates are porous, capable of retaining aerosol forming material when not in use, and capable of releasing aerosol forming material during the period when the smoker draws on the smoking article.

One type of substrate material useful herein is a thermally stable material (e.g., a material capable of withstanding temperatures of about 400° C. to about 600° C. without decomposing or burning). Examples of such materials include porous grade carbons, graphite, carbon yarns, activated and non-activated carbons, and ceramics. Suitable carbon substrate materials include PC-25 and PG-60 available form Union Carbide Corp., SGL available from Calgon Carbon Corp., Pittsburgh, Pa., and Catalog Nos. CFY-0204-1, CN-157(HC), CN-210(HC), ACN-211-10 and ACN-157-10 form American Kynol Inc. Molecular sieves, such as Smellrite TM available from Union Carbide Corp., may also be used, in part or in whole, as a substrate herein. Other suitable substrate materials include alpha alumina beads available as D2-2600 Sintered Alpha Alumina from W. R. Grace & Co. and the like.

Another useful type of substrate has the form of a densified pellet formed form carbon, tobacco, alumina, or mixtures thereof. Preferred densified pellets can be manufactured using a Marumerizer available from Fuji Paudal KK, Japan. See, U.S. Pat. No. 4,893,639 (White), the disclosure of which is hereby incorporated herein by reference.

Another type of substrate useful herein has the form of a cellulose material, such as paper or tobacco paper. Such a substrate typically is provided as a cylindrical segment including a gathered web of paper within a circumscribing outer wrapper. Such cylindrical segments can be provided from rods which are manufactured using equipment and techniques described in U.S. Pat. No. 4,807,809 (Pryor et al.). Exemplary papers which are gathered to form substrates are available as P144-B from Kimberly-Clark Corp.

Another alternative to the solid substrates discussed above is a congealed thin film material that binds, traps, and encapsulates tobacco particles, humectants, and aerosol forming materials. Such materials may be formed by combining tobacco, flavors and other ingredients with a gel forming substance, such as gelatin, alginates, albumin, agar-agar, casein, gum arabic, pectins, and the like. When heated, this material breaks down to release the encapsulated components, adding to or forming a smoke-like aerosol.

More than one type of substrate material can be employed in the aerosol generating means. For example, alumina beads which carry one or more aerosol forming materials can be positioned behind the fuel element, and a cylindrical segment of gathered paper carrying additional aerosol forming materials can be positioned behind the alumina beads.

The aerosol generating means includes an aerosol forming material. The aerosol forming material can have a liquid, semi-solid or solid form, and is generally carried by a substrate. Examples of preferred aerosol forming materials include polyhydric alcohols (e.g., glycerin, propylene glycol and triethylene glycol), aliphatic esters of mono-, di-, or poly-carboxylic acids (e.g., methyl stearate, dimethyl dodecandioate and dimethyl tetra decanedioate), and the like. Additional examples of suitable aerosol forming materials include volatile flavoring agents and tobacco flavor modifiers. Volatile flavoring agents include vanillin, cocoa, licorice, organic acids, sugars, and the like. Tobacco flavor modifiers include asparagine, levulinic acid, glucose pentaacetate, and the like.

As described above, a heat conductive capsule or container is advantageously employed herein to promote the heat exchange relationship between the fuel element and the aerosol generating means. The heat conductive capsule preferably is formed from a metallic sheet strip or foil. Typically, the thickness of the capsule or container wall ranges form about 0.01 mm to about 0.2 mm. The thickness, shape and/or type of material used to manufacture the capsule can vary in order to provide the desired degree of heat transfer. A preferred heat conducting member is manufactured from thin aluminum sheet which is deep drawn to form a cylindrical capsule of about 30 mm in length and approximately 4.6 mm in outer diameter.

In the preferred embodiments of the present invention, the heat conductive capsule which contains the substrate and the aerosol forming material is attached to the mouthend piece; although a mouthend piece, such as a cigarette holder, can be provided separately. The mouthend piece provides a passageway which channels the vaporized aerosol forming materials into the mouth of the smoker; and can also provide further flavor to the vaporized aerosol forming materials. Preferably, the length of the mouthend piece ranges from 30 mm to about 85 mm, but it can vary (longer or shorter) as dictated by the needs or demands of the article. Preferably the length of the mouthend piece is such that (i) the burning portion of the fuel element and the hot heat conducting member are kept away from the mouth and fingers of the smoker; and (ii) hot vaporized aerosol forming materials have sufficient time to cool before reaching the mouth of the smoker.

Suitable mouthend pieces normally are inert with respect to the aerosol forming material, offer minimum aerosol loss as a result of condensation of filtration, and are capable of withstanding the temperatures experienced during use of the smoking article. Exemplary mouthend pieces include plasticized cellulose acetate tubes, such as is available as SCS-1 from American Filtrona Corp.; polyimide tubes available as Kapton from E. I. duPont de Nemours; paperboard or heavy paper tubes; and aluminum foil-lined paper tubes.

A segment of very loosely gathered tobacco paper can be incorporated into the mouthend piece. Such a segment can be positioned directly behind the heat conducting member which contains the aerosol forming material. If desired, a segment of gathered carbon paper can be incorporated into the mouthend piece, particularly in order to introduce menthol flavor to the aerosol. Suitable gathered carbon paper segments are described in European Patent Application No. 342,538.

The extreme mouth end of the smoking article preferably includes a filter element or "filter tip," particularly for aesthetic reasons. Preferred filter elements are low efficiency filter elements which do not interfere appreciably with aerosol yields. Suitable filter materials include low efficiency cellulose acetate or polypropylene tow, baffled or hollow molded polypropylene materials. Suitable filter elements can be provided by gathering a non-woven polyethylene web available as PP-100-F from Kimberly-Clark Corp. using the filter rod forming apparatus described in Example 1 of U.S. Pat. No. 4,807,809 to Pryor et al. Another useful filter material is a high denier (low density) cellulose acetate, available from Tennessee Eastman.

As described above, the smoking articles of the present invention incorporate many forms of tobacco. The forms of tobacco may vary, and more than one form of tobacco is often incorporated into a particular embodiment. For instance, in addition to the tobacco/glass wrapper surrounding the fuel element, tobacco can also be incorporated in the fuel element itself. As mentioned above, tobacco can also be positioned within the aerosol generating means, and/or positioned within the mouthend piece in a manner such that various flavorful tobacco components are transferred to drawn aerosol passing through the mouthend piece. The type of tobacco can vary, and includes flue-cured, Burley, Md. and Oriental tobaccos, the rare and specialty tobaccos, as well as blends thereof.

One form of tobacco is tobacco cut filler e.g., strands or shreds of tobacco filler having widths of about 1/20 inch to about 1/40 inch, and lengths of about ¼ inch to about 3 inches. Tobacco cut filler can be provided from tobacco laminae, processed tobacco stems including cut-rolled or cut-puffed stems, or reconstituted tobacco material. Cut filler normally is incorporated into the cigarette as a cylindrical roll, or charge of tobacco material, which is wrapped in a circumscribing paper wrapper. Rods or rolls of cut filler can be provided using cigarette rod making techniques and apparatus which..are well known to the skilled artisan. Tobacco cut filler also can be incorporated in the aerosol generating means, if desired. As described above, this type of cut filler is typically used to surround the aerosol generating means in the preferred cigarettes of this invention.

Another form of tobacco which is used extensively in this invention is tobacco paper. In addition to its use in the tobacco/glass wrapper for the fuel element, tobacco paper, such as, for example, a web of tobacco paper available as P144-B from Kimberly-Clark Corporation, can be loosely gathered into a cylindrical segment in a manner set forth in Example 2 of U.S. Pat. No. 4,807,809 (Pryor et al.). Such cylindrical segments of gathered tobacco paper can be incorporated (i) into the capsule or container of the cigarette to act as a substrate for the aerosol forming material, and/or (ii) within the mouthend piece of the cigarette. If desired, tobacco paper can line the inner region of the mouthend piece of the smoking article.

Another form of tobacco useful herein is finely divided tobacco material. Such a form of tobacco includes tobacco dust and finely divided tobacco laminae. Typically, finely divided tobacco material is carried by the substrate which is positioned within the capsule or container of the cigarette. However, finely divided tobacco material can also be incorporated into the fuel element.

Another form of tobacco useful herein is a tobacco extract. The extracts can be obtained by any of the number of methods known to those of ordinary skill in this art. Tobacco extracts typically are provided by extracting a tobacco material using a solvent such as water, carbon dioxide, sulfur hexafluoride, a hydrocarbon such as hexane or ethanol, a halocarbon such as a commercially available Freon, or other organic and inorganic solvents. Tobacco extracts can include spray dried tobacco extracts, freeze dried tobacco extracts, tobacco aroma oils and tobacco essences. Methods for providing suitable tobacco extracts are set forth in U.S. Pat. No. 4,506,682 (Mueller), European Patent Publication Nos. 326,370 and 338,831; and U.S. patent application Ser. No. 346,042 filed May 2, 1989; which are incorporated herein by reference.

Typically, at least one tobacco extract is carried by the substrate of the cigarette of the present invention, even though tobacco cut filler, tobacco paper and filter material may be positioned elsewhere within the cigarette. Furthermore, tobacco extract can be incorporated into the fuel element.

The entire length of the smoking article, or any portion thereof, can be overwrapped with cigarette paper. Preferred papers which circumscribe the heat conducting member should not openly flame during use of the smoking article, should have controllable smolder properties, and should produce a gray ash. Exemplary, cigarette papers are described in U.S. Pat. No. 4,779,631 (Durocher et al.) and European Patent Publication No. 304,766. Suitable paper wrappers are available as P1981-152, P1981-124, and P1224-63, from Kimberly-Clark Corp. Tipping paper can circumscribe the extreme mouth end of the smoking article. Suitable tipping papers include non-porous tipping papers treated with "non-lipsticking" materials, and others available to the skilled artisan.

An especially preferred wrapper for the fuel element end of the preferred cigarettes of the present invention is described in the copending application of Barnes et al. Ser. No. 07/574,327 filed Aug. 28, 1990, entitled "SMOKING ARTICLE WITH IMPROVED WRAPPER," filed on Aug. 28, 1990. The wrapper described therein, which encircles at least a portion of the insulating material around the fuel element, comprises a high porosity paper treated with a burn retardant in an amount sufficient to prevent a substantial amount of the cellulosic content of the paper from burning out during smoking. This maintains the integrity of the front end of the cigarette during use. The disclosure of this application is hereby incorporated herein by reference.

The present invention will be further illustrated with reference to the following examples which will aid in the understanding of the present invention, but which are not to be construed as a limitation thereof. All percentages reported herein, unless otherwise specified, are percent by weight. All temperatures are expressed in degrees Celsius.

EXAMPLE 1

Cigarettes substantially as illustrated in FIG. 1, were prepared as follows:

Fuel Source Preparation

A generally cylindrical fuel element 9 mm long and 4.5 mm in diameter, and having an apparent (bulk) density of about 1.02 g/cc is prepared from about 72 parts hardwood pulp carbon having an average particle size of 12 microns in diameter, about 20 parts of blended tobacco dust including Burley, flue cured and oriental, the dust being approximately 200 Tyler mesh, and 8 parts Hercules 7HF SCMC binder.

The hardwood pulp carbon is prepared by carbonizing a non-talc containing grade of Grand Prairie Canadian kraft hardwood paper under nitrogen blanket, increasing the temperature in a step-wise manner sufficient to minimize oxidation of the paper, to a final carbonizing temperature of at least 750° C. The resulting carbon material is cooled under nitrogen to less than 35° C., and then ground to fine powder having an average particle size of about 12 microns in diameter.

The finely powdered hardwood carbon is admixed with the tobacco dust, the sodium carboxymethyl cellulose binder, and sufficient water to provide a mixture having a stiff, dough-like paste form.

Figure 1B:
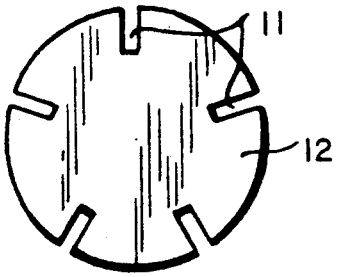
FIG. 1B is a front end view (i.e., the lighting end) of the preferred fuel element of the present invention, illustrating the passageway configuration and position therein.

Fuel elements are extruded using a ram extruder from the paste so as to have 5 equally spaced peripheral passageways in the form of slots or grooves, each having a depth of about 0.032 inch and a width of about 0.016 inch. The configuration of the passageways which extend longitudinally through the fuel element is shown in FIG. 1B. The resulting extrudate is dried in air to provide a resilient extrudate, and the extrudate is cut into 9 mm lengths, thereby providing fuel elements.

Substrate Preparation

The substrate is a densified particulate material consisting of 45 parts of a D2-2600 sintered Alpha alumina from W. R. Grace & Co. in powdered form having an average particle size of 15 microns in diameter, 15 parts of carbon powder having a particle size of 15 microns in diameter, 10 parts of a blended tobacco dust approximately 200 Tyler mesh, 10 parts of cased blended tobacco dust approximately 200 Tyler mesh, 19 parts glycerin and 1 part flavors. The substrate is produced by extruding a paste of the above composition onto a rapidly spinning disk which results in the formation of small, roughly spherical balls of the substrate material. The process is generally described and the apparatus is identified in U.S. Pat. No. 4,893,639 (White).

Cartridge Assembly

A hollow metal container is manufactured from aluminum using a metal drawing process. The container has a length of about 30 mm, outer diameter of about 4.6 mm, and an inner diameter of about 4.4 mm. One end of the container is open; and the other end is sealed, except for two slot-like openings, which are about 0.65 mm by 3.45 mm in size and spaced about 1.14 mm apart.

About 340 mg of the substrate is loaded into the container. Then, the fuel element is inserted into the open end of the container to a depth of about 2 mm. As such, the fuel element extends about 7 mm beyond the open end of the container.

Insulating Jacket

A 15 mm long, 4.5 mm diameter plastic tube is overwrapped with an insulating jacket material that is also 15 mm in length. In these cigarette embodiments, the insulating jacket is composed of 2 layers of Owens-Corning C-glass mat, each about 1 mm thick prior to being compressed by the jacket forming machine, and after formation, each being about 0.6 mm thick. Sandwiched between the two layers of C-glass is one sheet of reconstituted tobacco paper, about 0.13 mm thick, and a second sheet of 0.13 mm thick reconstituted tobacco paper overwraps the outer layer of glass. The reconstituted tobacco paper sheet, designated P2674-157 from Kimberly-Clark Corp., is a paper-like sheet containing a blended tobacco extract. The width of the reconstituted tobacco sheets prior to forming are 19 mm for the inner sheet and 26.5 mm for the outer sheet. The final diameter of the jacketed plastic tube is about 7.5 mm.

Tobacco Roll

A tobacco roll consisting of volume expanded blend of Burley, flue cured and oriental tobacco cut filler is wrapped in a paper designated as P1487-125 from Kimberly-Clark Corp., thereby forming a tobacco roll having a diameter of about 7.5 mm and a length of about 22 mm. See U.S. patent application Ser. No. 07/505,339, filed 5 Apr. 1990, for a preferred volume expanded tobacco process.

Front End Assembly

The insulating jacket section and the tobacco rod are joined together by a paper overwrap designated as P2674-190 from Kimberly-Clark Corp., which circumscribes the length of the tobacco/glass jacket section as well as the length of the tobacco roll. The mouth end of the tobacco roll is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco roll, simultaneously as the drill and the engaged plastic tube are withdrawn from the mouth end of the roll. The cartridge assembly is inserted until the lighting end of the fuel element is flush with the front end of the insulating jacket. The overall length of the resulting front end assembly is about 37 mm.

Mouthend Piece

The mouthend piece includes a 20 mm long cylindrical segment of a loosely gathered tobacco paper and a 20 mm long cylindrical segment of a gathered web of non-woven, melt-blown polypropylene, each of which includes an outer paper wrap. Each of the segments are provided by subdividing rods prepared using the apparatus described in U.S. Pat. No. 4,807,809 (Pryor et al.).

The first segment is about 7.5 mm in diameter, and is provided from a loosely gathered web of tobacco paper available as P1440-GNA from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as PP-100 from Kimberly-Clark Corp. which is circumscribed by a paper plug wrap available as P1487-184-2 from Kimberly-Clark Corp.

The two segments are axially aligned in an abutting end-to-end relationship, and are combined by circumscribing the length of each of the segments with a paper overwrap available as L-1377-196F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the front end assembly adjacent the mouthend piece with tipping paper.

Use

In use, the smoker lights the fuel element with a cigarette lighter and the fuel element burns. The smoker inserts the mouth end of the cigarette into his/her lips, and draws on the cigarette. A visible aerosol having tobacco flavor is drawn into the mouth of the smoker.

EXAMPLE 2

Cigarettes substantially as illustrated in FIG. 1, were prepared as follows:

Fuel Source Preparation The fuel source is prepared as in Example 1.

Substrate Preparation

The substrate is prepared as in Example 1.

Cartridge Assembly

The cartridge assembly is prepared as in Example 1.

Insulating Jacket

The assembled fuel element/capsule assembly combination is overwrapped, at the fuel element end, with an insulating jacket material that is 15 mm in length. The insulating jacket begins as 2 layers of material, a first layer of Owens-Corning C-glass mat and a second layer of reconstituted tobacco paper. The C-glass mat is placed over the tobacco paper and the cartridge assembly is placed thereon. The jacket is formed by spirally winding the two sheets around the cartridge assembly, in a spiral manner, akin to a "jelly-roll." The final diameter of the jacketed fuel element is about 7.5 mm.

Tobacco Roll

A tobacco roll consisting of volume expanded blend of Burley, flue cured and oriental tobacco cut filler is wrapped in a paper designated as P1487-125 from Kimberly-Clark Corp., thereby forming a tobacco rod having a diameter of about 7.5 mm and a length of about 22 mm. Insertion of a probe into one end of the tobacco rod provides a longitudinal passageway of about 4.5 mm diameter through the tobacco rod.

Front End Assembly

The container portion of the insulated cartridge assembly is inserted into the passageway in the tobacco roll until the insulating jacket abuts one end of the tobacco rod. The overwrapped insulating jacket section and the tobacco rod then are joined together by a paper overwrap designated as P2674-190 from Kimberly-Clark Corp., which circumscribes the length of the tobacco/glass jacket section as well as the length of the tobacco rod. The length of the resulting front end assembly is about 37 mm.

Mouthend Piece

The mouthend piece includes a 20 mm long cylindrical segment of a loosely gathered tobacco paper and a 20 mm long cylindrical segment of a gathered web of non-woven, melt-blown polypropylene, each of which includes an outer paper wrap. Each of the segments are provided by subdividing rods prepared using the apparatus described in U.S. Pat. No. 4,807,809 (Pryor et al.).

The first segment is about 7.5 mm in diameter, and is provided from a gathered web of tobacco paper available as P1440-GNA from Kimberly-Clark Corp. which circumscribed by a paper plug wrap available as P1487-184-2 from Kimberly-Clark Corp.

The second segment is about 7.5 mm in diameter, and is provided from a gathered web of non-woven polypropylene available as PP-100 from Kimberly-Clark Corp. which is circumscribed by a paper plug wrap available as P1487-184-2 from Kimberly-Clark Corp.

The two segments are axially aligned in an abutting end-to-end relationship, and are combined by circumscribing the length of each of the segments with a paper overwrap available as L-1377-196F from Simpson Paper Company, Vicksburg, Mich. The length of the mouthend piece is about 40 mm.

Final Assembly of Cigarette

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the front end assembly adjacent the mouthend piece with tipping paper.

Use

In use, the smoker lights the fuel element with a cigarette lighter and the fuel element burns. The smoker inserts the mouth end of the cigarette into his/her lips, and draws on the cigarette. A visible aerosol having tobacco flavor is drawn into the mouth of the smoker.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:

(a) a combustible fuel element; and (b) an insulating wrapper surrounding at lest a portion of the outer periphery of the fuel element, the insulating wrapper comprising at least two separate and distinct layers comprising:

(a) at least one layer of fibrous insulating material and (b) at least one layer of a tobacco-containing material.

2. The smoking article of claim 1, which further comprises at least two layers of fibrous insulating material.

3. The smoking article of claim 2, wherein the layer of fibrous insulating material further includes tobacco.

4. The smoking article of claim 2, wherein the insulating wrapper comprises a second layer of a tobacco-containing material.

5. The smoking article of claim 4, wherein at least one of the tobacco-containing layers is in sheet form.

6. The smoking article of claim 5, wherein the tobacco sheet material is interposed between two layers of fibrous insulating material.

7. The smoking article of claim 6, wherein both layers of the tobacco-containing materials are in sheet form.

8. The smoking article of claim 6, wherein the fibrous insulating material is glass fiber.

9. The smoking article of claim 8, wherein the arrangement of the glass and tobacco materials, outwardly from the fuel element comprises glass, tobacco, glass, tobacco.

10. The smoking article of claim 9, wherein the arrangement of glass and tobacco layers defines a concentric ring configuration.

11. The smoking article of claim 9, wherein the arrangement of glass and tobacco layers defines a spiral configuration.

12. The smoking article of claim 6, wherein the arrangement of the glass and tobacco materials, outwardly from the fuel element comprises tobacco, glass, tobacco, glass.

13. The smoking article of claim 12, wherein the arrangement of glass and tobacco layers defines a concentric ring configuration.

14. The smoking article of claim 13, wherein the arrangement of glass and tobacco layers defines a spiral configuration.

15. The smoking article of claim 1, which further includes an aerosol generating means, longitudinally disposed behind the fuel element.

16. The smoking article of claim 15, which further includes a mouthend piece.

17. The smoking article of claim 16, wherein the mouthend piece further contains flavor substances.

18. The smoking article of claim 17, wherein the flavor substances include tobacco.

19. The smoking article of claim 1, wherein the fuel element is less than about 30 mm in length prior to smoking.

20. The smoking article of claim 19, wherein the fuel element is carbonaceous.

* * * * *